United States Patent [19]

Metzner et al.

[11] 3,933,275

[45] Jan. 20, 1976

[54] PORTABLE WINE DISPENSER

[75] Inventors: Irving L. Metzner, Dover, N.J.; Daniel O'Connell, Pound Ridge, N.Y.

[73] Assignee: Colgate-Palmolive Company, New York, N.Y.

[22] Filed: Feb. 7, 1974

[21] Appl. No.: 440,283

[52] U.S. Cl. ..... 222/131; 211/74; 222/146 C; 222/181; 222/182; 248/129

[51] Int. Cl.[2] ..... B67D 5/60

[58] Field of Search ..... 222/173, 176, 180, 181, 222/182, 185, 146 C, 130, 131; 211/74, 49 R; 248/129, 311, 312; 312/291, 292, 140.2

[56] References Cited

UNITED STATES PATENTS

| | | | |
|---|---|---|---|
| 939,594 | 11/1909 | Fulper | 222/185 X |
| 1,991,102 | 2/1935 | Kernaghan | 211/49 R |
| 2,058,027 | 10/1936 | Martinet | 222/185 X |
| 2,132,255 | 10/1938 | Belshaw | 312/291 X |
| 3,195,777 | 7/1965 | Hart | 222/181 X |
| 3,712,514 | 1/1973 | Le Blanc | 222/146 C |

*Primary Examiner*—Stanley H. Tollberg
*Assistant Examiner*—Joseph J. Rolla
*Attorney, Agent, or Firm*—Herbert S. Sylvester, Esq.; Murray M. Grill, Esq.; Kenneth A. Koch, Esq.

[57] ABSTRACT

A portable beverage dispenser having a housing which contains a casing provided with a plurality of bottle receptacles for the purpose of holding bottles of beverage in an inverted position. Beverages flow from the bottle to individual cooling cups, which are disposed within an ice compartment, and from the cooling cups through pipes to individual spigots mounted on the outside of the housing. A hinged panel is provided on the casing to prevent accidental spilling of the beverage into the ice compartment when the bottles are installed in the housing. The housing has the overall configuration of a wooden barrel and is mounted on a wheeled chassis.

6 Claims, 8 Drawing Figures

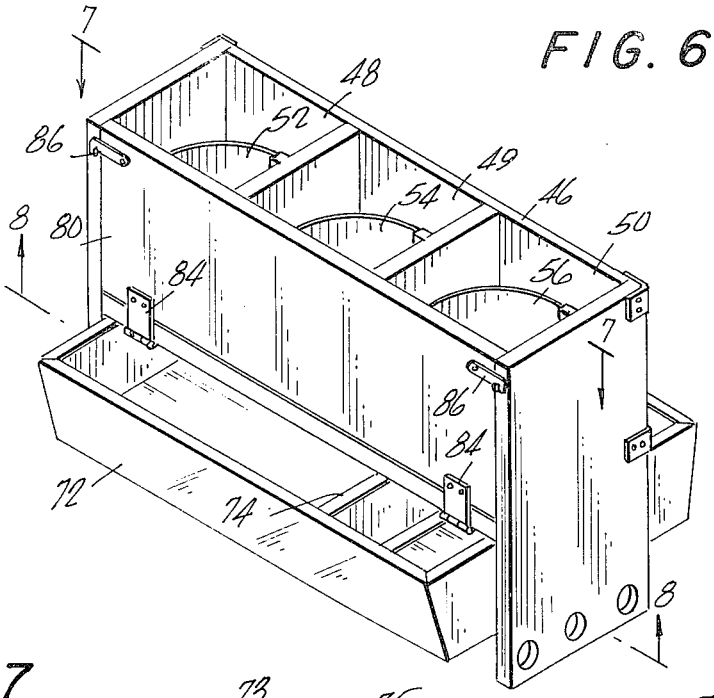
FIG. 6
FIG. 7
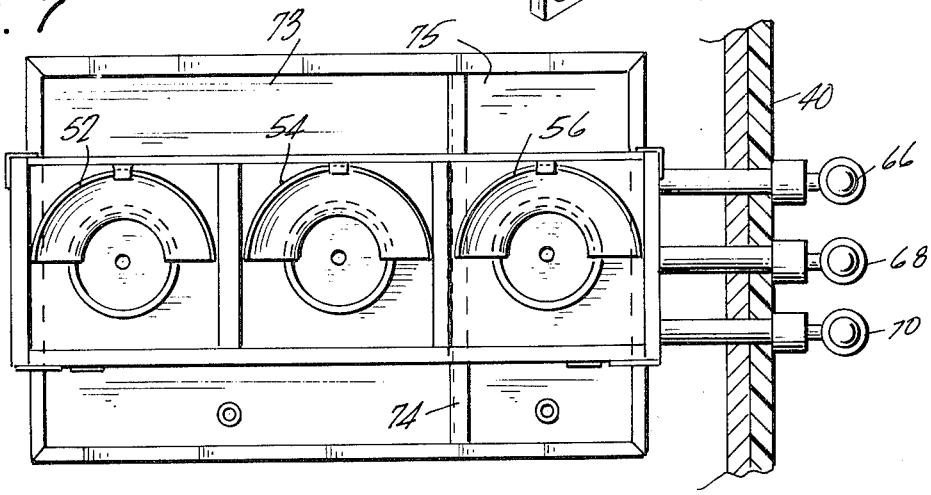
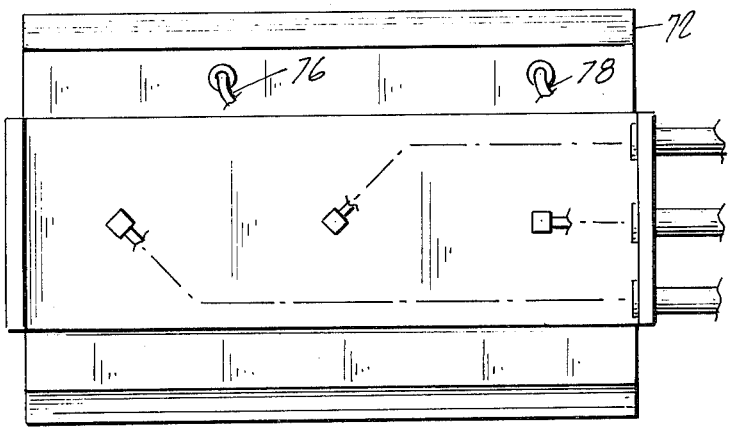
FIG. 8

PORTABLE WINE DISPENSER

BACKGROUND OF THE INVENTION

1. Field Of The Invention

This invention relates to a portable beverage dispenser, and more particularly to a highly ornamental and efficiently functional dispenser for chilled beverages such as wine and liquors.

2. Description Of The Prior Art

Conventionally the dispensing of wines and spirits in restaurants is done by waiters who deliver a bottle of wine to a table or alternatively glasses of wine or spirits to customers seated at individual tables. Conventionally, when a single glass of wine rather than a bottle is ordered by a customer a waiter must walk to a bar area, request the wine from a bartender and deliver the glass of wine to the customer's table. A disadvantage of this procedure is that it is time consuming in that the waiter must walk to the bar area, wait until the bartender can fill his request and then walk back to the customer. Another disadvantage of this procedure is that it interferes with the bartender's normal routine of serving customers who are sitting or standing at the bar.

SUMMARY OF THE INVENTION

The concept of this invention features the use of a novel portable beverage dispenser having means for storing, cooling and dispensing a plurality of different wines and spirits and which can be moved easily from table to table in a restaurant. It is to be understood that the portable beverage dispenser is equally adapted for home use as well as in clubs, institutions, and elsewhere.

Another object of the present invention is to provide a portable beverage dispenser having means for storing, cooling, and dispensing a plurality of beverages with certain of the beverages cooled to a greater degree than others.

An additional object of the present invention is to provide a portable beverage dispenser having cooling and dispensing means contained within an attractive housing constructed to have an appearance similar to a wooden barrel of the type used for ageing wine and spirits.

A yet further object of the present invention is to provide a portable beverage dispenser having a casing with a hinged panel disposed so as to protect ice stored within the casing from accidental spilling of wine or spirits or from other foreign matter.

Still further objects and features of this invention reside in the provision of a portable beverage dispenser which incorporates a convenient rack for storage of empty glasses and a rack for storage of bottles of wine and spirits.

These, together with the various ancillary objects and features of this invention, which will become apparent as the following description proceeds, are attained by the portable beverage dispenser preferred embodiments of which are illustrated in the accompanying drawing, by way of example only.

BRIEF DESCRIPTION OF THE DRAWINGS

FIG. 6 is a perspective view of the casing assembly;

FIG. 7 is a top plan view of the casing assembly looking along line 7—7 in FIG. 6; and, FIG. 8 is a bottom plan view of the casing assembly looking along the plane of line 8—8 in FIG. 6.

DESCRIPTION OF THE PREFERRED EMBODIMENTS

Figure 1:
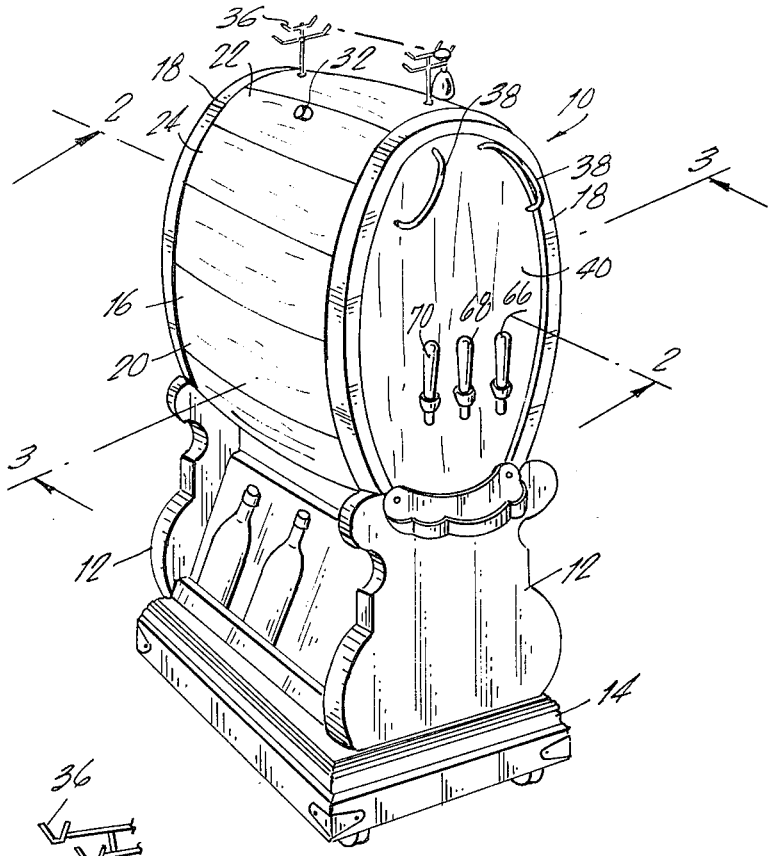
FIG. 1 is an perspective view of a portable beverage dispenser constructed in accordance with the concept of the present invention.

With continuing reference to the accompanying drawing, wherein like reference numerals designate similar parts throughout the various views, reference numeral 10 is used to generally designate a portable beverage dispenser constructed in accordance with the concepts of the present invention.

Figure 4:
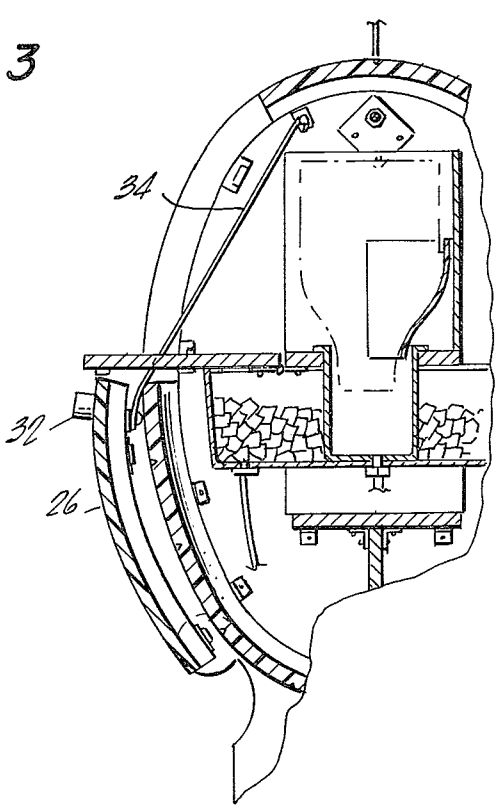
FIG. 4 is a partial vertical sectional view also looking along the plane of the line 3—3 in FIG. 1, but showing the relative position of the components when the housing cover and the hinged panel on the casing are opened.
Figure 3:
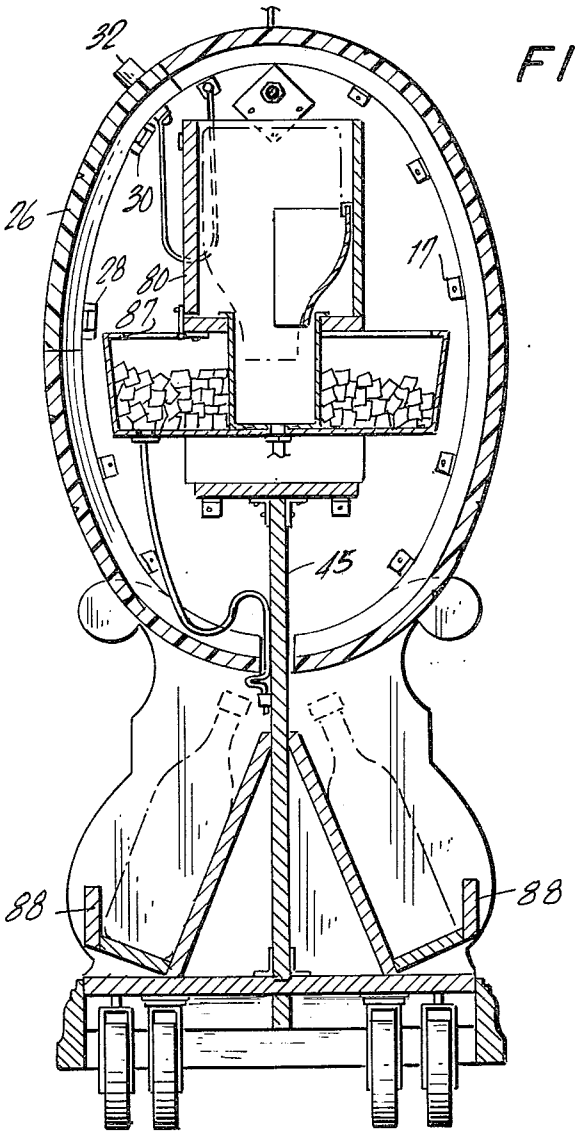
FIG. 3 is a vertical sectional view taken along the plane of the line 3—3 in FIG. 1.

The dispenser 10 includes supports 12 which are mounted on a chassis 14. A housing 16 is mounted on the supports 12 and includes rims 18 mounted on the front and rear end plates 40 and 41 of housing 16. Rims 18 and housing wall 20, which has an outer surface divided into barrel staves, which are shown typically at 22 and 24, contribute to the overall appearance of housing 16 as being a wooden barrel of the type used for the ageing of wine and spirits. The housing wall 20 is fastened to the front and rear plates 40 and 41 by angle brackets 17. Housing 16 has the overall configuration of an oval barrel with walls outwardly bowed. Alternatively, housing 16 may have the overall configuration of a circular cylinder. Cover 26 in housing 16 is held in the closed position, shown in FIG. 3, by latches 28 and 30. Cover 26 may be opened by pulling cover handle 32 outward from said housing and then letting cover 26 hang from a pair of ropes 34 one of which is shown in FIG. 4. Ropes 34 each have one end attached to cover 26 and the other end attached to housing 16 and hangs within housing 16 when cover 26 is in the closed position.

A rack 36 is mounted on the upper portion of housing 16 for the purpose of storing drinking glasses. Handles 38 are mounted on the front plate 40 of the housing 16 for the purpose of assisting in the moving of the portable wine dispenser 10. A pair of front wheels 42 are mounted on the front of the chassis 14 and a pair of rear wheels 44 are mounted on the rear of the chassis 14. Rear wheels 44 are mounted with provisions for swivelling about a vertical axis to facilitate turning the portable beverage dispenser 10.

Figure 5:
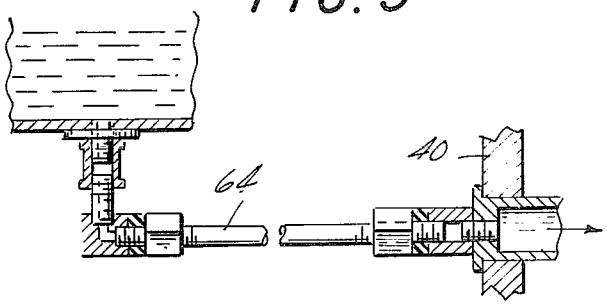
FIG. 5 is an enlarged fragmentary view showing conduit connections.

A casing assembly 46 is disposed within the housing 16 and is supported by a center support 45. The casing assembly 46 has a plurality of bottle compartments 48, 49 and 50. Each of the bottle compartments 48, 49 and 50 has a bottle receptacle 52,54 and 56 which have semi-circular cavities provided with an upper end of relatively larger diamter and a lower end of relatively smaller diameter for the purpose of accommodating and holding an inverted bottle of wine or spirits. The bottle receptacles 52,54 and 56 are mounted directly above cooling cups 58,60 and 62, respectively. The cooling cups are made of metal or of other material characterized by having relatively good thermal conductivity. The cooling cups 58, 60 and 62 each have a conduit assembly 64, shown in FIG. 5, which leads from the cooling cup 58, 60 or 62 through the front plate 40 to spigot assemblies 66, 68 or 70 respectively. The direction of the fluid flow is shown by the arrow in FIG. 5. The cooling cups are mounted in the receptacle 72 which is divided into two compartments 73 and 75 by wall 74. Drain tubes 76 and 78 are made of flexible material such as rubber or plastic and lead from the compartments 73 and 75 in ice receptacle 72 for the purpose of draining water that has collected from melting ice cubes. Drain tubes 76 and 78 pass through housing 16 and have clamps 79 to prevent leakage of water until such time as draining of the collected water is desired. Ice receptacle 72 is divided into compartments 73 and 75 for the purpose of enabling the selective placing of ice around selected cooling cups shown by way of example as cooling cups 58 and 60 are in compartment 73, in order to cool beverages in selected cups to a greater degree than beverage in cup 62 in compartment 75, large amounts of ice cube disposed in compartment 73 while little or no ice may be disposed in compartment 75, some beverages being served at room temperture.

Figure 2:
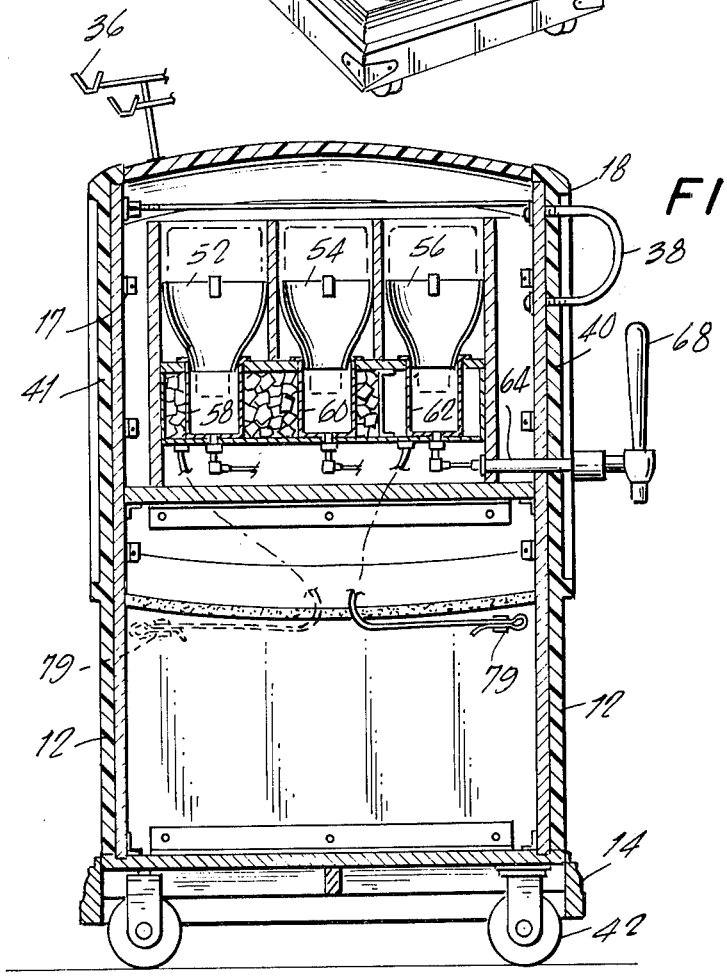
FIG. 2 is a vertical sectional view taken along the plane of line 2—2 in FIG. 1.

Hinged panel 80 is attached to casing assembly 46 by hinges 84 and latches 86. When bottles of wine or spirits are to be installed in the portable beverage dispenser 10 latches 86 are opened and hinged panel 80 is swung down from the vertical position shown in FIG. 3 to the horizontal position shown in FIG. 4. When in the horizontal position the hinged panel 80 covers opening 87 in the ice receptacle 72 thus preventing accidental spilling of wine or spirits into the ice receptacle 72 during the installation of bottles of wine or spirits into the bottle receptacles or during use of the panel as a working surface. When in the horizontal position panel 80 also reduces heating of the ice in the ice receptacle 72 by air from outside housing 16 thereby aiding the insulation of the ice receptacle 72. When hinged panel 80 is in the vertical position opening 87 in ice receptacle 72 communicates with the inside of housing 16 and ice contained in the ice receptacle 72 cools the air inside housing 16 and thus cools the outside surface of bottles of wine or spirits, shown in broken lines in FIG. 2, 3 and 4 that are installed in the bottle receptacles.

When the portable beverage dispenser is in use, the ice receptacle 72 is filled with ice cubes as desired and bottles of wine or spirits are opened, inverted and placed in the bottle receptacles. The wine or spirits flows into the cooling cups where it is cooled and through the pipe assemblies to the spigots. Additional bottles of wine or spirits are stored in racks 88 and empty bottles for receiving water from drain tubes may also be stored in racks 88 thus making the portable beverage dispenser a self-contained unit with provisions for storing, cooling and dispensing beverages.

A latitude of modification, substitution and change is intended in the foregoing disclosure and in some instances, some features of the invention will be employed without a corresponding use of other features.

What is claimed is:

1. A portable beverage dispenser comprising a support, a housing secured to said support, a casing carried by said support in said housing, said casing being divided into a plurality of bottle receptacles, compartments for ice secured to said casing, said housing having a movable upper wall portion, said casing having a hingedly mounted wall pivotable from an upwardly extending position to a horizontal position extending outwardly of said housing, said hingedly mounted wall being supported by an ice compartment when in said horizontal position, said compartments for ice having openings disposed to communicate with the interior of said housing when said hingedly mounted wall is in said upwardly extending position and disposed to be blocked by said hingedly mounted wall when said hingedly mounted wall is in said horizontal position.

2. A portable wine dispenser according to claim 1 further including a plurality of cooling cups disposed one each below said bottle receptacles and within said compartments for ice.

3. A portable beverage dispenser according to claim 1, including a wheeled chassis, said support rising upwardly from said chassis.

4. A portable beverage dispenser according to claim 1, wherein said bottle receptacles each have a cavity with the shape of a conical frustum cut longitudinally with said cavity having a relatively larger semi-circular end and a relatively smaller semi-circular end with said larger end disposed higher than said smaller end for the purpose of accommodating the neck of a bottle of liquid when said bottle is inverted.

5. A portable beverage dispenser according to claim 1, wherein said housing includes a plurality of staves forming the wall portion of said housing, a pair of circumferential bands each on an end of said wall portion a pair of end plates forming the end portions of said housing with said bands disposed to encircle said staves and a plurality of angle brackets secured to said staves to said end plates for securing said wall portion to the end plates of said housing.

6. A portable beverage dispenser according to claim 1, including a rack secured to said support with said rack disposed below said housing and comprising a first panel secured to said support and forming an acute angle with said support, a second panel secured to said first panel and extending at a right angle with said first panel, and a third panel secured to said second panel at an obtuse angle with said second panel for the purpose of storing bottles with said bottles supported by said first and second panels and prevented from falling outwardly from said rack by said third panel.

* * * * *